US008128108B2

(12) United States Patent
Madrid

(10) Patent No.: US 8,128,108 B2
(45) Date of Patent: Mar. 6, 2012

(54) SKATEBOARD BUBBLE PIPE

(76) Inventor: Jerry Madrid, Newport Beach, CA (US)

( * ) Notice: Subject to any disclaimer, the term of this patent is extended or adjusted under 35 U.S.C. 154(b) by 405 days.

(21) Appl. No.: 12/553,964

(22) Filed: Sep. 3, 2009

(65) Prior Publication Data

US 2011/0049826 A1 Mar. 3, 2011

(51) Int. Cl.
*B62M 1/00* (2010.01)

(52) U.S. Cl. ..... 280/87.042; 280/87.041

(58) Field of Classification Search ..... 280/87.041, 280/87.042, 87.05, 11.28, 11.203, 607, 11.27
See application file for complete search history.

(56) References Cited

U.S. PATENT DOCUMENTS 5,292,141 A * 3/1994 Ekedal et al. ..... 280/87.042
6,131,931 A * 10/2000 Globerson et al. ..... 280/87.042
6,273,440 B1 * 8/2001 Wilson ..... 280/87.042
6,290,249 B1 * 9/2001 Wolf ..... 280/609
6,527,284 B2 * 3/2003 Bert ..... 280/87.041
6,938,907 B2 * 9/2005 Hamy ..... 280/87.042
7,178,814 B2 * 2/2007 Mash ..... 280/87.042
7,425,017 B2 * 9/2008 Mash ..... 280/607
7,708,289 B2 * 5/2010 Jaime, Sr. ..... 280/11.203
2002/0030338 A1 * 3/2002 Bert ..... 280/87.041
2005/0029767 A1 * 2/2005 Chang ..... 280/87.042
2009/0011667 A1 * 1/2009 Hayward et al. ..... 441/74
2009/0160143 A1 * 6/2009 Fraley ..... 280/11.28

* cited by examiner

*Primary Examiner* — Hau Phan
(74) *Attorney, Agent, or Firm* — Kenneth L. Green

(57) ABSTRACT

A novelty skateboard includes features common in skateboards and further includes an air passage and a cup for producing bubbles. The skateboard includes a deck, two trucks, and four wheels. The deck is made from cross laminated layers of a wood material. The air passage is formed lengthwise through one or more of the layers in the center of the deck and reaches from one end of the deck to an opposite end of the deck, and may be formed by a hollow rectangular insert laminated into the deck. One of the trucks includes a bypass reaching from a base plate of the truck to the cup. The bypass may pass through a hollow kingpin of the truck, or through the hanger of the truck.

11 Claims, 4 Drawing Sheets

10a
13a
13b
12a
6
6

10a
13a
17a
16
14
12a
16a
14
13b
17b 10a
13a
17a
14
16
14

10a
13b
17b
14
16a
14

18
16
22a
22
24

18
16
22a
22
24
26
20
20
22b 18
16
5
5
22
24
26
20
20
22b
24

SKATEBOARD BUBBLE PIPE

BACKGROUND OF THE INVENTION

The present invention relates to novelty skateboards and in particular to a skateboard further serving as a bubble pipe.

Skateboards are commonly used for recreational activities and are very popular among young people. Known skateboards provide a single use known for many decades and enjoyed world wide. However, many younger skateboarders are known to enjoy a variety of activities and novelty items. Therefore, a skateboard offering the novelty of a clever alternate use is desirable.

BRIEF SUMMARY OF THE INVENTION

The present invention addresses the above and other needs by providing a novelty skateboard which includes features common in skateboards and further includes an air passage and a cup for producing bubbles. The skateboard includes a deck, two trucks, and four wheels. The deck is made from cross laminated layers of a wood material. The air passage is formed lengthwise through one or more of the layers in the center of the deck and reaches from one end of the deck to an opposite end of the deck, and may be formed by a hollow rectangular insert laminated into the deck. One of the trucks includes a bypass reaching from a base plate of the truck to the cup. The bypass may pass through a hollow kingpin of the truck, or through the hanger of the truck.

In accordance with one aspect of the invention, there is provided a skateboard and bubble pipe. The skateboard includes a deck, two trucks, and four wheels. The deck comprising cross laminated layers of wood material with a center layer having a longitudinally extending grain. A first truck is attached to a forward end of the deck and includes a first base plate, a first hanger, a first kingpin, and first bushings residing on the kingpin and sandwiching the hanger. A second truck is attached to a rear end of the deck and includes a second base plate, a second hanger, a hollow kingpin, and second bushings residing on the kingpin and sandwiching the hanger. The wheels attached to the trucks. A hollow insert is laminated into the deck and has a rectangular exterior cross-section and an interior passage, and reaches through the deck from a forward end of the deck to a rear end of the deck. An intermediate opening in the passage connects the passage to a bottom surface of the deck adjacent to the second truck and a bypass passage overlaps the intermediate opening and passes through the second base plate and the hollow kingpin. A cup resides on an exposed head of the hollow kingpin and in opens into the bypass passage.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 2:
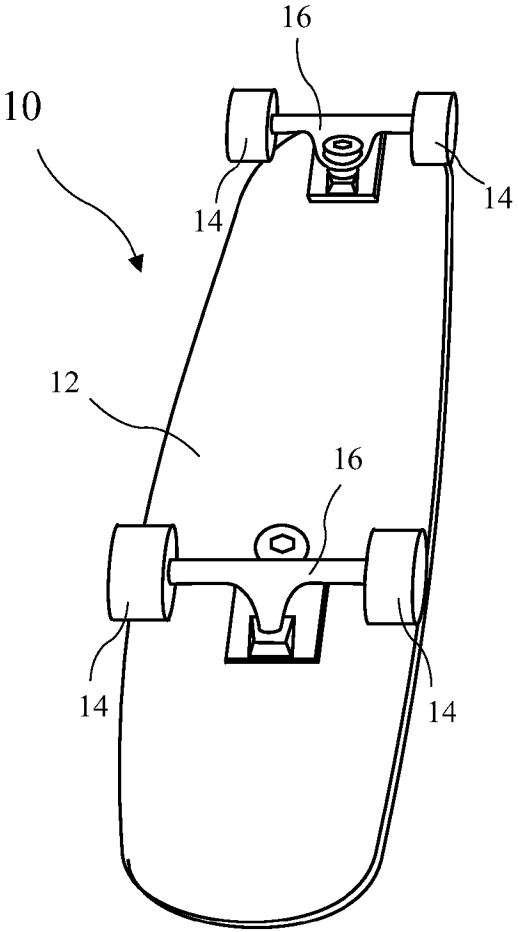
FIG. 2 (prior art)
FIG. 2 is a bottom perspective view of the prior art skateboard.
Figure 1:
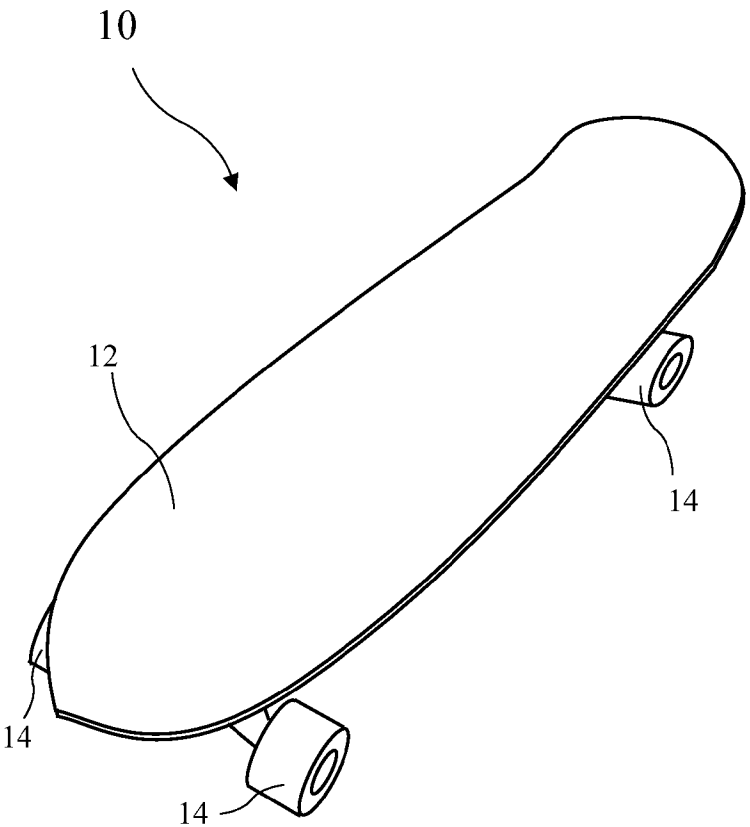
FIG. 1 (prior art)
FIG. 1 is a top perspective view of a prior art skateboard.

A top perspective view of a prior art skateboard 10 is shown in FIG. 1 and a bottom perspective view of the prior art skateboard 10 is shown in FIG. 2. The skateboard 10 includes a deck 12, trucks 16 mounted to the forward and rear ends of the deck, and wheels 14 mounted to the trucks 16.

Figures 3A, 3B, 3C, 3D, 4A, 4B, 4C:
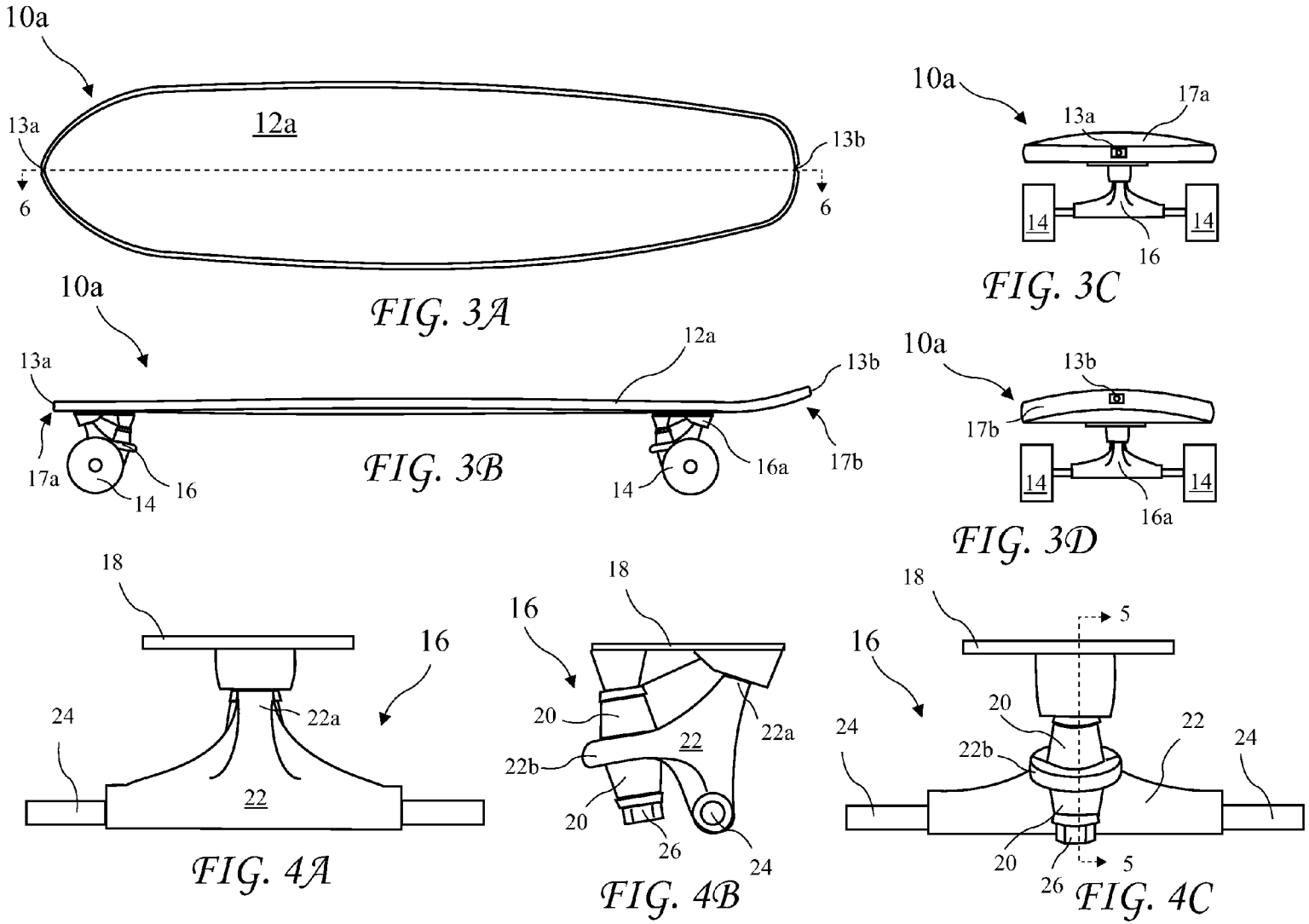
FIG. 3A is a top view of a skateboard according to the present invention.
FIG. 3B is a side view of the skateboard according to the present invention.
FIG. 3C is a front view of the skateboard according to the present invention.
FIG. 3D is a rear view of the skateboard according to the present invention.
FIG. 4A is a front view of a truck according to the present invention.
FIG. 4B is a side view of the truck according to the present invention.
FIG. 4C is a rear view of the truck according to the present invention.

A top view of a skateboard 10*a* according to the present invention is shown in FIG. 3A, a side view of the skateboard 10*a* is shown in FIG. 3B, a forward (or front) view of the skateboard 10*a* is shown in FIG. 3C, and a rear view of the skateboard 10*a* is shown in FIG. 3D. The skateboard 10*a* includes a passage 13 (see FIGS. 7 and 8) having a forward opening 13*a* at a forward end 17*a* of the deck 12 and a rear opening 13*b* at a rear end 17*b* of the deck 12.

A front view of the truck 16 according to the present invention is shown in FIG. 4A, a side view of the truck 16 is shown in FIG. 4B, and a rear view of the truck 16 is shown in FIG. 4C. The truck 16 includes a base plate 18 which attaches to the deck 12, a hanger 22 pivotally engaging the base plate 18 at a pivot end 22*a*, axles 24 reaching laterally from the hanger 22 for mounting the wheels 14, and a kingpin 26 holding the hanger 22 in place. Two bushings 20 reside on the kingpin 26 and sandwich a ring portion 22*b* of the hanger 22. The kingpin 26 may be tightened or loosened (or harder or softer bushings may be selected) to adjust the turning responsiveness of the skateboard.

Figure 6:
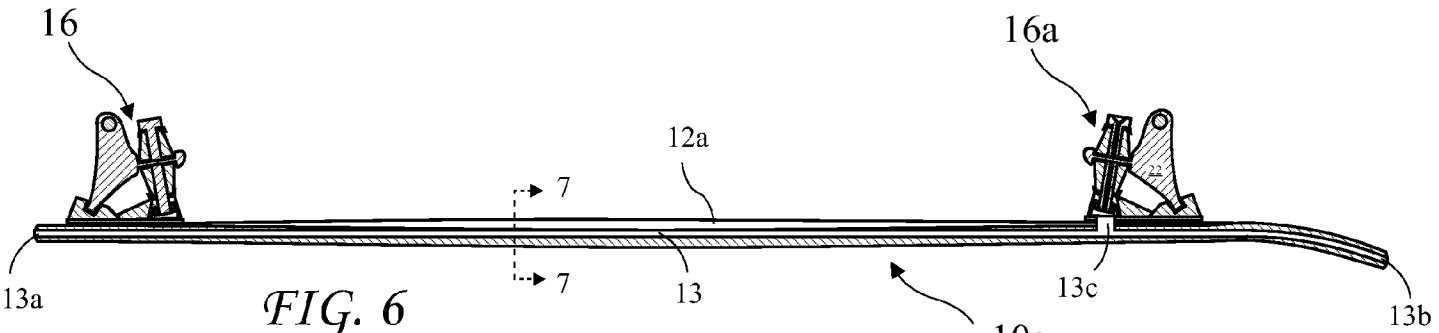
FIG. 6 is a cross-sectional view of the skateboard according to the present invention taken along line 6-6 of FIG. 3A.
Figure 5A:
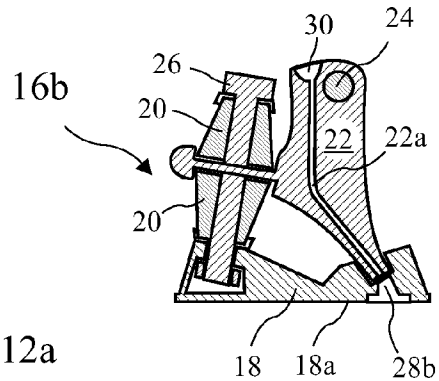
FIG. 5*a* is a cross-sectional view of a second truck according to the present invention taken along line 5-5 of FIG. 4A.
Figure 5:
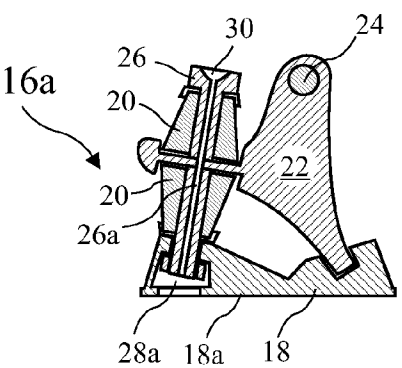
FIG. 5 is a cross-sectional view of the truck according to the present invention taken along line 5-5 of FIG. 4A.

A cross-sectional view of the truck 16*a* according to the present invention taken along line 5-5 of FIG. 4C is shown in FIG. 5 and a cross-sectional view of the skateboard 10*a* taken along line 6-6 of FIG. 3A is shown in FIG. 6. The truck 16*a* includes a hollow kingpin 26 with a passage 26*a* and a first opening 28*a* through the base plate 18, to provide a bypass passage through the truck 16*a* from a mounting surface 18*a* of the base plate 18 to a cup 30. The opening 28*a* overlaps an intermediate opening 13*c* in the deck 12 to place the cup 30 in fluid communication with the passage 13.

A cross-sectional view of a second truck 16*b* according to the present invention taken along line 5-5 of FIG. 4C is shown in FIG. 5A. The truck 16*b* includes a hanger 22 with a bypass passage 22*a* placing the cup 30 in fluid communication with the passage 13.

Figure 8:
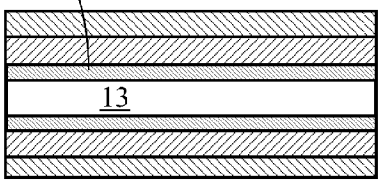
FIG. 8 is a cross-sectional view of the skateboard deck according to the present invention taken along line 8-8 of FIG. 7.
Figure 7:
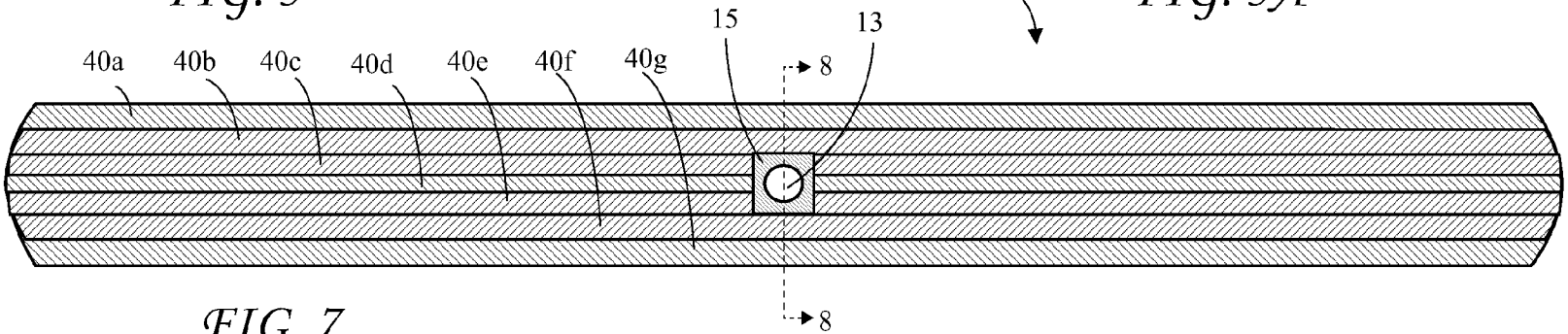
FIG. 7 is a cross-sectional view of the skateboard deck according to the present invention taken along line 7-7 of FIG. 6.

A cross-sectional view of the skateboard deck 17*a* taken along line 7-7 of FIG. 6 is shown in FIG. 7 and a cross-sectional view of the skateboard deck 12*a* taken along line 8-8 of FIG. 7 is shown in FIG. 8. The deck 12*a* comprises cross and straight laminated layers 40*a*-40*g* of wood material with a center layer having a longitudinally extending grain. The passage 13 is preferably a passage in a hollow insert 15 laminated into the deck 12*a*. The hollow insert 15 conforms to a void area in the laminated layers of wood material forming the deck 12 and for example, may have a rectangular outer cross-section, another uniform cross-section, or an irregular cross-section. The insert 15 is preferably made of high-density polypropylene material or a similar material.

Figure 9:
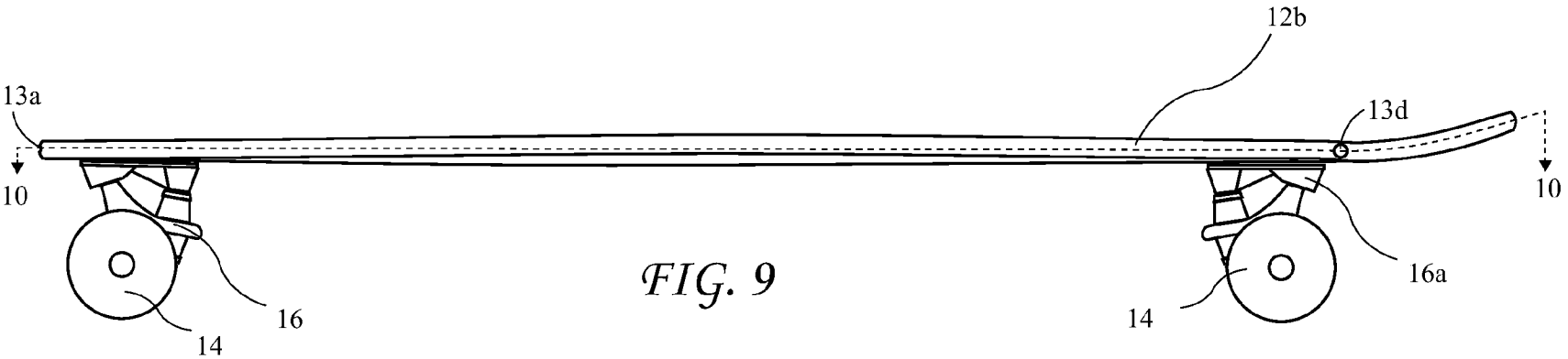
FIG. 9 is a side view of the skateboard deck according to the present invention.
Figure 10:
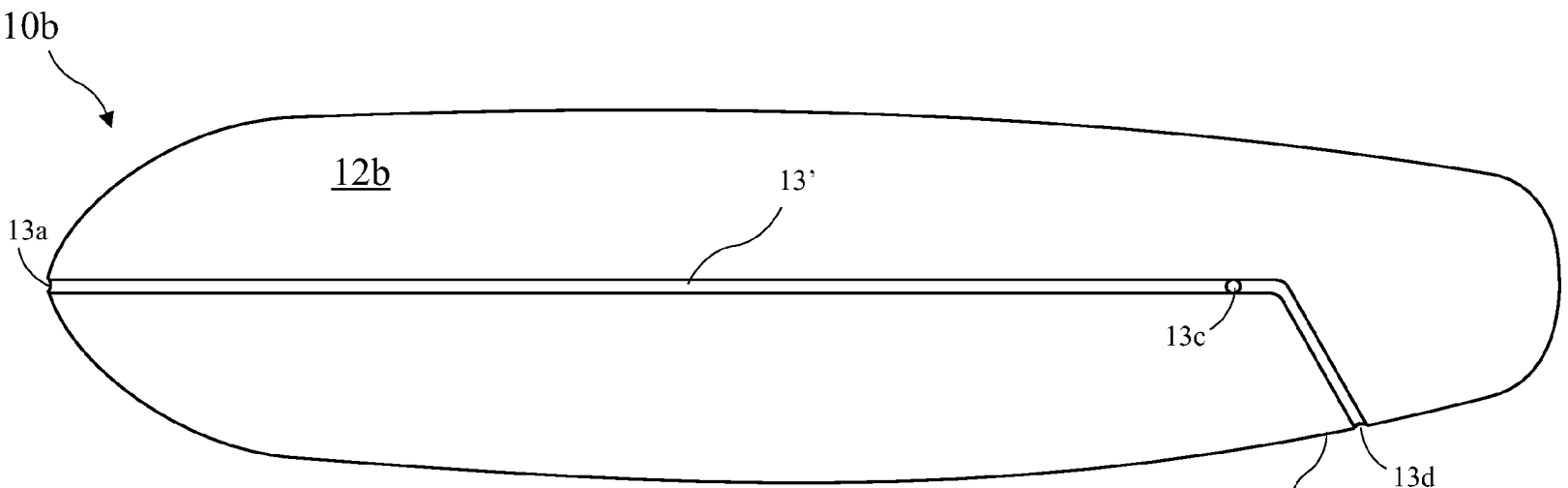
FIG. 10 is a cross-sectional view of the skateboard deck according to the present invention taken along line 10-10 of FIG. 9.

A side view of a second skateboard deck 12*b* according to the present invention is shown in FIG. 9 and a cross-sectional view of the skateboard deck 12*b* taken along line 10-10 of FIG. 9 is shown in FIG. 10. The deck 12*b* includes a curved passage 13' which reaches the truck 16*a* or 16*b*, but then turns to a side edge 32 of the deck 12*b*. The deck 12*b* is otherwise similar to the deck 12*a*.

While the skateboard described above includes a deck, two trucks, and four wheels, skateboards are known which replace one of the two wheel trucks with a single wheel. All skateboard including the passage and bypass through a truck or other wheel mounting including such variations are intended to come within the scope of the present invention.

While the invention herein disclosed has been described by means of specific embodiments and applications thereof, numerous modifications and variations could be made thereto by those skilled in the art without departing from the scope of the invention set forth in the claims.

I claim:

1. A skateboard comprising:

a deck;

a first truck attached to a forward end of the deck, the forward truck comprising a first base plate, a first hanger, a first kingpin, and first bushings residing on the kingpin and sandwiching the hanger;

a second truck attached to a rear end of the deck, the rear truck comprising a second base plate, a second hanger, a second kingpin, and second bushings residing on the kingpin and sandwiching the hanger;

wheels attached to the trucks;

a passage through the deck having an open first end and an open second end opposite the first end;

an intermediate opening in the passage connecting the passage to a bottom surface of the deck;

a bypass passage through one of the trucks connecting a mounting surface of the base plate to an exposed surface of the truck; and a cup on an exposed surface of the truck and opening into the bypass passage.

2. The skateboard of claim 1, wherein the passage through the deck reaches from a forward end of the deck to a rear end of the deck.

3. The skateboard of claim 1, wherein the deck comprises cross and straight laminated layers of wood material with a center layer having a longitudinally residing grain and the passage is vertically centered on the center layer.

4. The skateboard of claim 3, wherein the passage comprises a hollow insert laminated into the deck.

5. The skateboard of claim 4, wherein the hollow insert has an outside cross-section conforming to an opening through the laminated layers of wood material forming the deck.

6. The skateboard of claim 3, wherein the passage is a straight passage reaching from a forward end of the deck to a rear end of the deck.

7. The skateboard of claim 3, wherein the passage is a curved passage reaching from an end of the deck, under one of the trucks, and to a side surface of the deck.

8. The skateboard of claim 1, wherein the kingpin is hollow providing the bypass passage.

9. The skateboard of claim 1, wherein the bypass passage is through the hanger.

10. A skateboard comprising:

a deck;

a first truck attached to a forward end of the deck, the forward truck comprising a first base plate, a first hanger, a first kingpin, and first bushings residing on the kingpin and sandwiching the hanger;

a second truck attached to a rear end of the deck, the rear truck comprising a second base plate, a second hanger, a second kingpin, and second bushings residing on the kingpin and sandwiching the hanger;

wheels attached to the trucks;

a passage through the deck having an open first end and an open second end opposite the first end;

an intermediate opening in the passage connecting the passage to a bottom surface of the deck;

a bypass passage through one of the kingpins connecting a mounting surface of the base plate to an exposed surface of the truck; and a cup on an exposed head of the kingpin, the cup opening into the bypass passage.

11. A skateboard comprising:

a deck comprising cross laminated layers of wood material with a center layer having a longitudinally extending grain;

a first truck attached to a forward end of the deck, the forward truck comprising a first base plate, a first hanger, a first kingpin, and first bushings residing on the kingpin and sandwiching the hanger;

a second truck attached to a rear end of the deck, the rear truck comprising a second base plate, a second hanger, a hollow kingpin, and second bushings residing on the kingpin and sandwiching the hanger;

wheels attached to the trucks;

a hollow insert laminated into the deck and having a rectangular exterior cross-section and an interior passage, the hollow insert reaching through the deck from a forward end of the deck to a rear end of the deck;

an intermediate opening in the passage connecting the passage to a bottom surface of the deck adjacent to the second truck;

a bypass passage overlapping the intermediate opening, through the second base plate, and the hollow kingpin; and a cup on an exposed head of the hollow kingpin and in opening into the bypass passage.

* * * * *